US006443330B1

(12) United States Patent
Kuboshima

(10) Patent No.: US 6,443,330 B1
(45) Date of Patent: Sep. 3, 2002

(54) CONTAINER FOR ADHESIVE AGENTS AND THE LIKE

(75) Inventor: Yasuyuki Kuboshima, Tokyo (JP)

(73) Assignee: Florex Co., Ltd., Tokyo (JP)

( * ) Notice: Subject to any disclaimer, the term of this patent is extended or adjusted under 35 U.S.C. 154(b) by 0 days.

(21) Appl. No.: 09/816,910

(22) Filed: Mar. 23, 2001

(30) Foreign Application Priority Data

Nov. 29, 2000 (JP) ..... 2000-363127

(51) Int. Cl.[7] ..... B65D 47/10

(52) U.S. Cl. ..... 222/153.06; 222/482; 222/541.5; 222/541.8; 222/541.9

(58) Field of Search ..... 222/153.06, 541.5, 222/541.8, 541.9, 482

(56) References Cited

U.S. PATENT DOCUMENTS 2,295,865 A * 9/1942 Rentschler ..... 222/541.8 X
2,317,420 A * 4/1943 Taylor ..... 220/265
3,777,949 A * 12/1973 Chiquiari-Arias ..... 222/541.8
4,134,544 A * 1/1979 Deussen ..... 215/48
4,319,701 A * 3/1982 Cambio ..... 222/541.9 X
5,228,593 A * 7/1993 O'Meara ..... 222/541.5 X
5,255,804 A * 10/1993 Butterbrodt ..... 215/48 X
5,423,440 A * 6/1995 Castaneda et al. ..... 215/49
5,425,920 A * 6/1995 Conti et al. ..... 422/102

* cited by examiner

*Primary Examiner*—Kenneth Bomberg
(74) *Attorney, Agent, or Firm*—Koda & Androlia

(57) ABSTRACT

A container for, for instance, an adhesive agent, comprising a main cap and a container main body formed with a nozzle section that has a twist-off cap that can be separated from and opens the nozzle section; wherein the main cap is formed therein with an accommodating section that holds the twist-off cap, and the main cap is rotatably mounted on the nozzle section. When the main cap is turned or twisted, the twist-off cap inside the main cap is twisted and separated from the nozzle section but stays inside the accommodating section of the main cap even after the main cap is detached from the container main body.

7 Claims, 3 Drawing Sheets

CONTAINER FOR ADHESIVE AGENTS AND THE LIKE

BACKGROUND OF THE INVENTION

1. Field of the Invention

The present invention relates to a container used mainly for accommodating liquid-form or paste-form contents that have ample fluidity, such as adhesive agents.

2. Prior Art

Conventionally known plastic containers for liquid-form contents that have ample fluidity such as instant adhesive agents are made of, for instance, polyethylene. In such containers, a small-diameter nozzle hole is opened upon use by a pin in the tip end of the nozzle section, or the tip end of a sealed nozzle of the container having a small-diameter nozzle hole is opened by being cut away. After this, the contents are applied to objects. The contents of the container are stored for future use by inserting a pin into the nozzle hole or fitting a cap tightly over the tip end of the nozzle.

However, the above containers have drawbacks. When the nozzle hole is opened by a pin, or when the tip end of the nozzle section is cut away, since such opening or cutting away is done after the cap is removed from the container main body, it is likely that the contents of the container jet out by the gripping pressure of the hand of a user. When this happens, the contents adhere to the skin, clothing, etc. Furthermore, the pin or cap become separated from the container and may be lost after the container is opened.

SUMMARY OF THE INVENTION

The present invention is to solve the above problems.

The object of the present invention is to provide a twist-off type container that is opened by twisting off the tip end of the nozzle and is free from the problems seen in the existing containers.

The above object is accomplished by a unique structure for a container for adhesive agents and the like, wherein the container comprises:

- a container main body provided with a nozzle section that squirts out the contents of the container, the nozzle section having a twist-off cap that can be separated from and opens the nozzle section; and
- a main cap removably mounted on the nozzle section, and in the present invention:
  - the main cap is provided with an accommodating section which accommodates the twist-off cap, the accommodating section restricting the rotation of the twist-off cap about the axis thereof when the main cap is mounted on the nozzle section;
  - the main cap is mounted on the nozzle section so as to be rotatable about the axis thereof;
  - a twist-off section is formed between the nozzle section and the twist-off cap so that the twist-off cap is separated from the nozzle section when the twist-off cap is twisted.

In the above structure, either the container main body or the main cap or both of them is made of an elastic material so as to possess resilience.

In addition, a detent portion is formed between the main cap and the twist-off cap so as to hold the twist-off cap in a fixed position inside the cap accommodating section of the main cap. The detent portion holds the twist-off cap when the main cap is mounted on the nozzle section, and it further holds the twist-off cap even after the twist-off cap is separated from the nozzle section.

Furthermore, in the container of the present invention, an axially oriented nozzle hole is formed in the twist-off section so that the nozzle hole communicates with the interior of the container main body and squirts out the contents of the container after the twist-off cap is removed.

In the above structure, it is preferable to form the interior of the twist-off cap hollow.

Furthermore, in the container of the present invention, the main cap is put on the container main body so that the container is sealed off from the outside, and an engagement section is provided in the engaging surfaces of the main cap and container main body so as to hold the main cap in a fixed position when the main cap is put on the container main body.

DETAILED DESCRIPTION OF THE INVENTION

Figure 1:
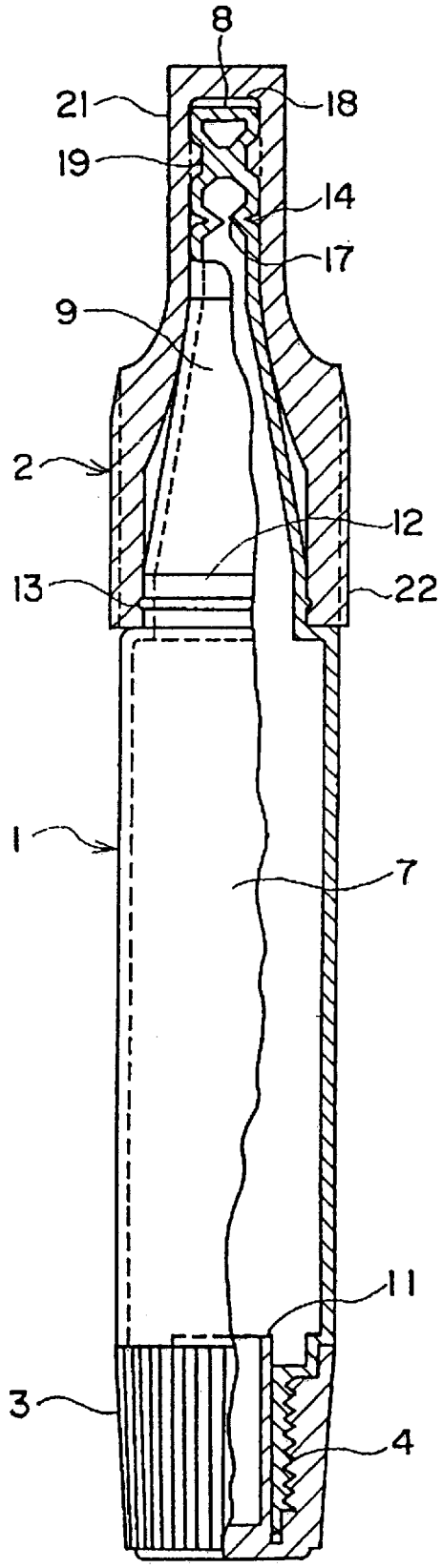
FIG. 1 is a sectional side view of the essential portion of the container according to the present invention.
Figure 2:
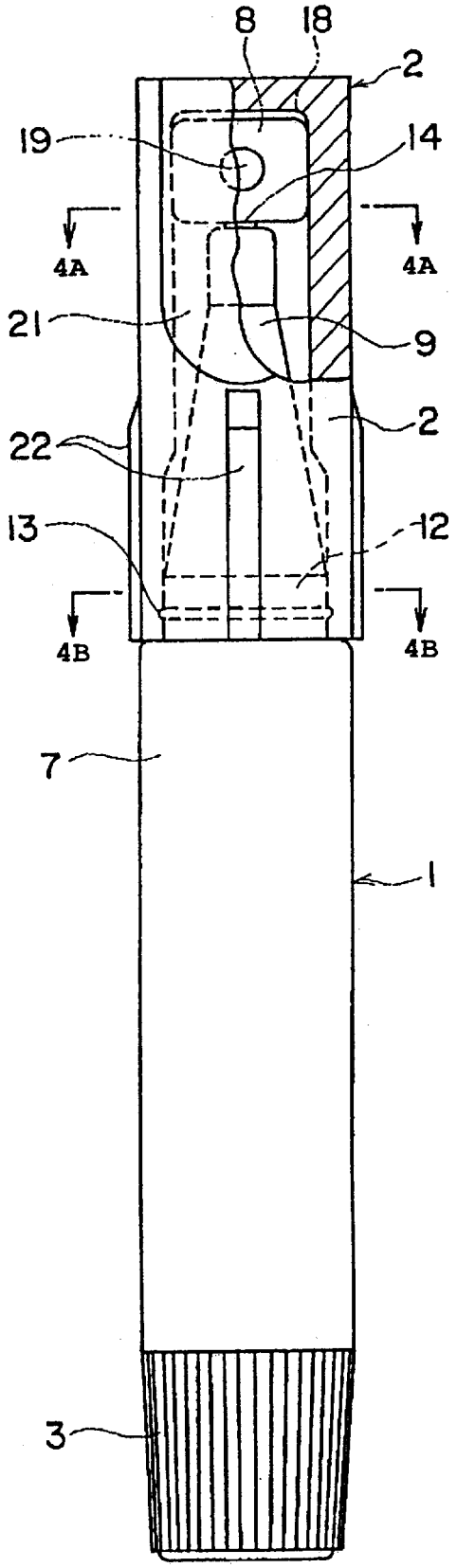
FIG. 2 is a sectional side view of the essential portion of the container.

In FIGS. 1 and 2, the container for, for instance, adhesives, has a total length of approximately 70 mm and a diameter of approximately 10 mm. The container comprises a container main body 1, a main cap 2 and a bottom cover 3 that are made of a transparent or semi-transparent plastic material that possesses resilience such as a polyethylene plastic.

The container main body 1 comprises a tubular main body 7 and a conical nozzle section 9. The tubular main body 7 has a threaded sleeve 4 formed on its lower end. The conical-cylindrical nozzle section 9 is formed on the upper end of the main body 7 so as to be continuous to the main body 7. In addition, a twist-off cap 8 is continuously formed at the upper end of the nozzle section 9.

The threaded sleeve 4 forms an open end for accommodating liquid-form contents such as an adhesive agent into the main body 7. The bottom cover 3 is screwed to the threaded sleeve 4. An insertion sleeve 11 is formed in the center of the interior of the bottom cover 3 so that the bottom portion of the main body 7 is sealed when the insertion sleeve 11 is pushed into the inside of the threaded sleeve 4.

Figure 3:
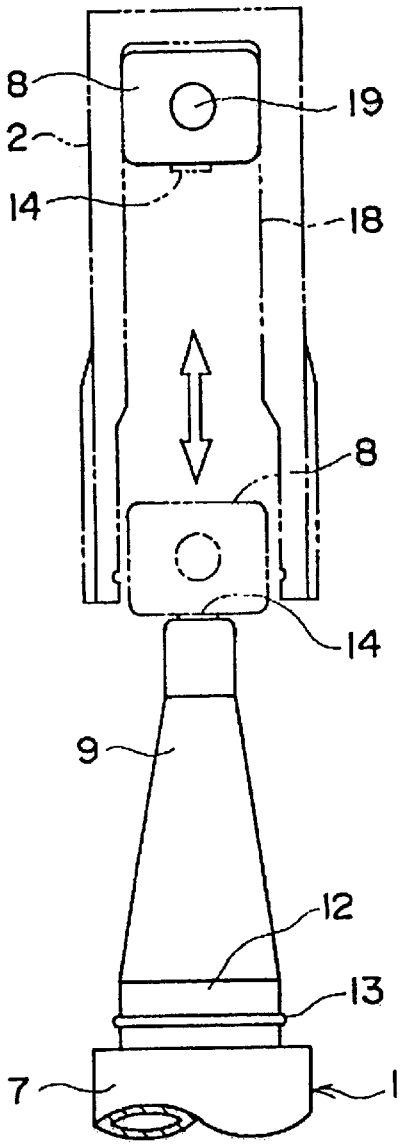
FIG. 3 shows the relationship between the main cap on the nozzle section of the container of the present invention.
Figure 4A:
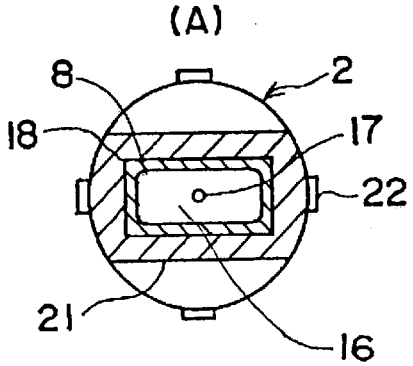
FIGS. 4A and 4B are sectional views taken along lines 4A—4A and 4B—4B, respectively, in FIG. 2.
Figure 4B:
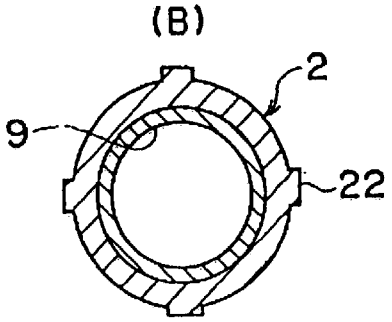

The lower end portion of the nozzle section 9 forms an engaging circumferential surface 12. The engaging circumferential surface 12 is a cylinder that has a specified height and a diameter that is smaller than the diameter of the main body 7. The lower end portion of the main cap 2 thus makes a tight engagement with the engaging circumferential surface 12 of the nozzle section 9 (see FIG. 4B). An engagement section 13 is formed between the outer surface of the engaging circumferential surface 12 and the inner circumferential surface of the lower end of the main cap 2. The engagement section 13 elastically holds the main cap 2 on the nozzle section 9 by a constant fastening force in a specified position when the main cap 2 is put on the container main body 7 so that the main cap 2 is prevented from coming off of the main body 7. The engagement section 13 increases tight sealing properties of the engagement. The engagement section 13 has a known structure; and it, as best seen from FIG. 3, comprises a ring-form indentation formed on the main cap 2 and the ring-form projection formed on the nozzle section 9 that tightly engage with each other.

The twist-off cap 8 is formed so as to be integrally continuous to the tip end of the nozzle section 9 with twist-off section 14 in between. The twist-off section 14 is in a shape of circumferentially oriented cut-in grooves. As seen from FIG. 4A, the twist-off cap 8 is formed in a non-circular box or block shape such as a square, circle, etc.; and it is somewhat flat when seen from above. The twist-off cap 8 shown in FIG. 4A has a hollow part 16. A nozzle hole 17 that is a small-diameter hole oriented in an axial direction of the nozzle 9 is formed in the center of the twist-off section 14. The nozzle hole 17 communicates with the hollow part of the twist-off cap 8. As will be described later, the nozzle hole 17 squirts out the contents after the twist-off cap 8 is separated by being twisted from the nozzle section 9 at the twist-off section 14.

The deepest portion (or inside upper most portion) of the interior of the main cap 2 forms an accommodating section 18. The accommodating section 18 conforms to the outer circumference of the twist-off cap 8 and can accommodate therein the twist-off cap 8 in an engaged fashion when the main cap 2 is mounted on the nozzle section 9 (and twist-off cap 8) in the axial direction of the nozzle section (see FIG. 4A). Thus, when the main cap 2 is rotated relative to the container main body 1, the twist-off cap 8 is rotated together with the main cap 2, and the twist-off cap 8 is separated from the nozzle section 9 by being twisted and cut at the twist-off section 14.

Furthermore, a detent portion 19 is formed between the main cap 2 and the twist-off cap 8. More specifically, the detent portion 19 comprises projecting portions of the main cap 2 and corresponding recessed portions of the twist-off cap 8. The projecting portions have a convex shape formed on the inner surface of the accommodating section 18 of the main cap 2. The recessed portions have a dish shape or concave shape and formed on the center of the front and back circumferential surfaces of the twist-off cap 8. The projecting portions of the main cap 2 elastically engages the recessed portions of the twist-off cap 8, so that the twist-off cap 8 is held in a fixed position inside the accommodating section 18 when the main cap 2 is mounted on the nozzle 9 after the twist-off cap 8 has been separated from the nozzle 9.

On the exterior of the main cap 2, cutout planes are formed on the front and back surfaces of the upper half of the main cap 2 so as to form grip sections 21. The grip sections 21 are used when the main cap 2 is rotated. Furthermore, spline-form projections 22 for preventing slipping during the rotation of the main cap are formed on the outer circumference of the lower half of the main cap 2.

In the container as described above, the contents such as an adhesive agent are accommodated in the container from the lower end opening with the main cap mounted on the container main body 1. When the adhesive agent is to be extracted from the container, the lower end opening is closed with the bottom cover 3, and the main cap 2 is rotated about the axis of the container main body 1. With this rotation, the twist-off cap 8 that is at the tip end of the nozzle section 9 and in the accommodating section 18 of the main cap 2, is rotated or twisted and separated from the nozzle section 9 at the twist-off section 14. As a result, the container is opened.

Though the container is thus opened, the nozzle hole 17 at the tip end of the nozzle section 9 is still in a closed state by the twist-off cap 8, since the twist-off section 14 which has been cut and separated is in an elastically pressed state by the main cap 2. As a result, jetting out of the adhesive agent from the container is prevented. Even if some of the adhesive agent should jet out, the adhesive agent remains inside the closed main cap 2. Thus, there is no jetting of the adhesive agent contents to the outside.

Then, the main cap 2 is pulled in the axial direction of the nozzle section 9, overcoming the fastening force of the engagement section 13. When the main cap 2 is thus removed, the twist-off cap 8 remains in a fixed position inside the accommodating section 18 of the main cap 2 by the detent portion 19. When the tip end of the nozzle section 9 is to be closed after the use of the contents, the main cap 2 is put back on the nozzle section 9. This results in that the tip end of the nozzle section 9 is tightly closed off from the outside with the twist-off cap 2 and the main cap 2. Furthermore, the nozzle hole 17 is tightly closed by being pressed against the surface of the twist-off section that remains on the lower end of the twist-off cap 8. The nozzle hole 17 in the twist-off cap 8 is plugged by the adhesive agent, and the tip end of the nozzle section 9 is not left opened.

As seen from the above, according to the present invention, the contents of the container such as an adhesive container is prevented from jetting out when the nozzle is opened by being cut. Thus, adhesion of the adhesive agent to the skin, clothing, etc. can be prevented. When the container is stored after use, leakage of the contents that would be resulted from opening of a plug as seen in the prior art containers is prevented, and the deterioration in quality of the contents can be prevented until next time the adhesive agent is used.

What is claimed is:

1. A container for adhesive agents, comprising:

a container main body provided with an elongated conical nozzle section that squirts out contents of said container through said nozzle section, said nozzle section being integrally formed with a twist-off cap that can be separated from and opens said nozzle section to allow said contents to squirt out of an opened end of said nozzle section; and a main cap removably mounted on said nozzle section, wherein:

said twist-off cap has a substantially rectangular cross-sectional shape;

said main cap is formed therein with an accommodating section having a substantially rectangular cross-sectional shape substantially the same as said substantially rectangular cross-sectional shape of said twist-off cap and accommodates said twist-off cap in an engaged fashion;

said main cap has at least two portions with different exterior cross-sections, a first portion formed below said accommodating section having a circular cross-section and a second portion surrounding said accommodating section having flattened opposing sides and a substantially rectangular cross-section;

at least four spline-form projections are formed spaced apart, equi-distantly on and longitudinally of said first portion of said main cap;

said main cap is rotatable on said nozzle section about an axis of said main cap;

said main and twist-off caps and nozzle section are made from a plastic; and said twist-off cap is separated from said nozzle section when said main cap is rotated together with said twist-off cap inside said accommodating section of said main cap.

2. The container according to claim 1, wherein at least said container main body or said main cap is an elastic member that possesses resilience.

3. The container according to claim 1, further comprising a detent portion that holds said twist-off cap inside said cap accommodating section after said main cap is detached from said nozzle section of said container main body.

4. The container according to claim 1, wherein an interior of said twist-off cap is hollow.

5. The container according to claim 1, wherein said main cap is engaged with said container main body so that said container is sealed off from outside, and an engagement section is formed in engaging surfaces of said main cap and container main body so as to hold said main cap in a fixed position when said main cap is mounted on said container main body.

6. The container according to claim 1 farther comprising a bottom cover for closing an open end of said container main body in an end of said container main body opposite said elongated conical nozzle section and wherein:

said bottom cover threadably attaches to a thread provided on said open end;

said bottom cover is provided with an insertion sleeve which fits into and seals said open end; and said bottom cover is provided with longitudinally extending ribs.

7. The container according to claim 6, wherein a total length of said container is substantially 70 mm and a diameter is substantially 10 mm.

* * * * *